US011951594B2

(12) United States Patent
Kawahara

(10) Patent No.: US 11,951,594 B2
(45) Date of Patent: Apr. 9, 2024

(54) POLISHING TOOL FOR NARROW PART, METHOD OF MANUFACTURING POLISHING TOOL, POLISHING METHOD, AND METHOD OF MANUFACTURING IMPELLER

(71) Applicant: MITSUBISHI HEAVY INDUSTRIES COMPRESSOR CORPORATION, Tokyo (JP)

(72) Inventor: Kosei Kawahara, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 1241 days.

(21) Appl. No.: 16/110,327

(22) Filed: Aug. 23, 2018

(65) Prior Publication Data

US 2019/0217445 A1 Jul. 18, 2019

(30) Foreign Application Priority Data

Jan. 18, 2018 (JP) ..... 2018-006052

(51) Int. Cl.
*B24B 5/06* (2006.01)
*B24B 5/40* (2006.01)
(Continued)

(52) U.S. Cl.
CPC ..... *B24D 15/04* (2013.01); *B24B 5/06* (2013.01); *B24B 5/40* (2013.01); *B24B 19/14* (2013.01);
(Continued)

(58) Field of Classification Search
CPC ..... B24D 15/04; B24D 18/009; B24D 3/001; B24D 3/002; B24D 3/004; B24B 19/006;
(Continued)

(56) References Cited

U.S. PATENT DOCUMENTS 661,282 A * 11/1900 Bachman ..... B24D 15/023 433/125
2,906,650 A * 9/1959 Wheaton ..... A01J 7/02 134/8
(Continued)

FOREIGN PATENT DOCUMENTS

JP H10-235552 A 9/1998
JP H11-156704 A 6/1999
(Continued)

*Primary Examiner* — Eileen P Morgan
(74) *Attorney, Agent, or Firm* — Osha Bergman Watanabe & Burton LLP

(57) ABSTRACT

To uniformly bring an abrasive into contact with a workpiece and to achieve desired surface roughness. A polishing tool sliding on a narrow part of the workpiece includes an abrasive retaining layer configured to allow an abrasive to be retained on a surface, and an elastic layer that is stacked on the abrasive retaining layer and is configured to press the abrasive retained in the abrasive retaining layer against the workpiece. The elastic layer is preferably elastically deformable over a sliding stroke of the polishing tool, and a driving unit that causes the polishing tool to slide on the workpiece is preferably connected to the polishing tool.

4 Claims, 10 Drawing Sheets

(51) Int. Cl.

| | |
|---|---|
| ***B24B 19/14*** | (2006.01) |
| ***B24B 29/08*** | (2006.01) |
| ***B24B 57/02*** | (2006.01) |
| ***B24D 3/00*** | (2006.01) |
| ***B24D 15/04*** | (2006.01) |
| ***B24D 18/00*** | (2006.01) |

(52) U.S. Cl.
CPC ..... *B24B 29/08* (2013.01); *B24B 57/02* (2013.01); *B24D 3/002* (2013.01); *B24D 3/004* (2013.01); *B24D 18/009* (2013.01)

(58) Field of Classification Search
CPC ..... B24B 19/009; B24B 19/02; B24B 19/08; B24B 19/14; B24B 19/20; B24B 5/06; B24B 5/08; B24B 5/10; B24B 5/40; B24B 5/48; B24B 23/04; B24B 23/043; B24B 29/00; B24B 29/02; B24B 29/08; B24B 33/02; B24B 33/025; B24B 33/027; B24B 57/02
USPC ... 451/36, 61, 344, 356, 462, 495, 514, 523, 451/530, 533, 913
See application file for complete search history.

(56) References Cited

U.S. PATENT DOCUMENTS

| | | | | | |
|---|---|---|---|---|---|
| 3,670,463 | A * | 6/1972 | Christian | B24D 11/00 | 451/526 |
| 3,719,460 | A * | 3/1973 | Brockman | B24D 15/00 | 401/38 |
| 4,428,717 | A * | 1/1984 | Catterfeld | F04D 7/04 | 415/217.1 |
| 4,490,948 | A * | 1/1985 | Hanstein | B24D 13/18 | 451/60 |
| 5,555,585 | A * | 9/1996 | Fowler | B08B 9/055 | 15/104.062 |
| 5,707,279 | A * | 1/1998 | Mitchell | B24D 9/02 | 451/514 |
| 5,800,252 | A * | 9/1998 | Hyatt | B24B 33/105 | 451/481 |
| 5,980,685 | A | 11/1999 | Kimura | | |
| 6,527,620 | B1 * | 3/2003 | Moellenberg, Jr. | B24B 33/085 | 451/470 |
| 7,278,908 | B2 * | 10/2007 | Urban | B24B 13/012 | 451/259 |
| 8,246,424 | B2 * | 8/2012 | Philipps | B24D 18/00 | 451/550 |
| 9,138,871 | B2 * | 9/2015 | Field | B24B 7/184 | |
| 9,302,369 | B2 * | 4/2016 | Elfizy | B23Q 11/12 | |
| 11,059,150 | B2 * | 7/2021 | Fang | B24D 15/04 | |
| 2011/0108526 | A1 * | 5/2011 | Kishimoto | F04D 29/284 | 451/28 |
| 2019/0134779 | A1 * | 5/2019 | Kawasumi | B24C 3/32 | |

FOREIGN PATENT DOCUMENTS

| | | | |
|---|---|---|---|
| JP | 2004-098267 | A | 4/2004 |
| JP | 2017-180178 | A | 10/2017 |
| WO | 99/26761 | A1 | 6/1999 |

* cited by examiner

POLISHING TOOL FOR NARROW PART, METHOD OF MANUFACTURING POLISHING TOOL, POLISHING METHOD, AND METHOD OF MANUFACTURING IMPELLER

BACKGROUND

Field

The present disclosure relates to a polishing tool for a narrow part that is usable to polish a workpiece including an odd-shaped cross-section, for example, an impeller, a polishing method, a method of manufacturing an impeller, and a method of manufacturing the polishing tool.

Description of the Related Art

An impeller provided in a centrifugal rotary machine such as a centrifugal compressor is required to have sufficient smoothness on a wall surface of a flow path in order to suppress friction loss of working fluid to achieve predetermined performance.

Therefore, it is necessary to polish a wall of the flow path after the impeller is fabricated by cutting, electro-discharge machining, fused deposition modeling using metal powder, or the like.

In JP 2017-180178 A, the wall of the flow path of the impeller is polished by a mechanical polishing method to inject an abrasive (abrasive grains) to the wall of the flow path. In addition to the mechanical polishing method, a chemical polishing method using chemical liquid is also well-known.

In JP 2017-180178 A, the abrasive is supplied together with compressed air to a nozzle member inserted into the flow path, and the abrasive is injected toward the wall of the flow path from a large number of holes provided in the nozzle member (blast).

It is difficult to uniformly bring the abrasive into contact with a workpiece. Therefore, even when a polishing process is performed for a long time, polishing unevenness occurs, and it is difficult to achieve desired surface roughness of a narrow part such as the wall of the flow path of the impeller.

The present disclosure is directed to uniformization of a contact state of the abrasive to the workpiece, and to achievement of the desired surface roughness.

SUMMARY

It is confirmed by the inventors of the present disclosure that, when abrasive grain dispersed fluid in which abrasive grains are dispersed into a viscoelastic medium flows through a flow path of a workpiece, it is possible to achieve desired surface roughness of a wall of the flow path. The inventors of the present disclosure conceive of a polishing method applicable to a workpiece including an odd-shaped cross-section, such as a flow path, based on the new findings.

According to the above-described findings, it is considered that the abrasive grains in the abrasive grain dispersed fluid come into contact with a surface of the workpiece with stable uniform pressure by the viscoelastic medium elastically isotropically deformed accompanied with flowing while being dispersed into the viscoelastic medium, which achieves the desired surface roughness. The polishing process, however, takes a long time because the abrasive grains are dispersed into the viscoelastic medium and contact probability of the abrasive grains to the surface of the workpiece is not high.

In terms of reduction of the time necessary for the polishing, a direct polishing method of causing a grindstone or the like to slide on the workpiece is suitable. An elastic grinding wheel having elasticity is elastically deformed along a shape of the workpiece; however, the elastic grinding wheel does not have elasticity enough to be elastically deformed following a shape of a complicated narrow part such as a flow path. Accordingly, it is difficult to bring the elastic grinding wheel into contact with the surface of the workpiece with uniform pressure to uniformize the contact state.

The inventors of the present disclosure conceive of a polishing tool that enables a direct polishing method applicable to a workpiece including an odd-shaped cross-section, such as a flow path, and a polishing method using the polishing tool, through the above-described speculations.

A polishing tool according to the present disclosure is a polishing tool sliding on a narrow part of a workpiece, and the polishing tool includes an abrasive retaining layer configured to allow an abrasive to be retained on a surface, and an elastic layer that is stacked on the abrasive retaining layer and is configured to press the abrasive retained in the abrasive retaining layer against the workpiece.

In the polishing tool according to the present disclosure, the elastic layer is preferably elastically deformable over a sliding stroke of the polishing tool.

In the polishing tool according to the present disclosure, the polishing tool is preferably connected to a driving unit that causes the polishing tool to slide on the workpiece.

In the polishing tool according to the present disclosure, the polishing tool is preferably disposed inside the workpiece, and the abrasive retaining layer and the elastic layer are preferably stacked over a substantially entire region of a body surface of the polishing tool surrounded by a wall inside the workpiece.

In the polishing tool according to the present disclosure, the abrasive retaining layer preferably has a rough surface that allows the abrasive to be retained.

In the polishing tool according to the present disclosure, the elastic layer preferably includes a lattice structure.

In the above-described configuration, the elastic layer and the abrasive retaining layer both preferably include the lattice structure, and the abrasive retaining layer preferably has density higher than density of the elastic layer.

The polishing tool according to the present disclosure preferably further includes a support supporting the abrasive retaining layer and the elastic layer.

In the above-described configuration, the support is preferably hollow.

In the polishing tool according to the present disclosure, the abrasive preferably includes abrasive grains and a dispersion medium having fluidity, and the polishing tool preferably includes a first abrasive flow path and a second abrasive flow path. The first abrasive flow path is a hollow space and allows the abrasive to flow, and the second abrasive flow path supplies the abrasive from the first abrasive flow path to a body surface of the polishing tool.

In the above-described configuration, the dispersion medium preferably has viscoelasticity.

The polishing tool according to the present disclosure preferably has a shape taking after a wall of a flow path provided in an impeller as the workpiece.

Further, a method of manufacturing the above-described polishing tool according to the present disclosure fabricates at least a part of the polishing tool by additive manufacturing.

In the above-described configuration, the abrasive retaining layer and the elastic layer are preferably integrally fabricated by additive manufacturing.

Further, according to the present disclosure, a polishing method polishes, with use of the above-described polishing tool, the narrow part by deforming the elastic layer within an elastic range while causing the abrasive retaining layer to follow the narrow part.

A method of manufacturing an impeller according to the present disclosure includes fabricating an impeller including a flow path, and polishing a wall of the flow path of the impeller as the workpiece with use of the above-described polishing tool or by the above-described polishing method.

According to the present disclosure using the polishing tool, the abrasive retained in the abrasive retaining layer slides while being directly pressed, by the elastic layer, against the surface of the workpiece with stable uniform pressure. As a result, it is possible to uniformly and surely bring the abrasive into contact with the surface of the workpiece to polish the surface. Consequently, it is possible to achieve the desired surface roughness while reducing the time necessary for the polishing.

DETAILED DESCRIPTION OF EMBODIMENTS

Several embodiments of the present disclosure are respectively described below with reference to accompanying drawings.

In the following, a polishing tool according to the present disclosure, a polishing method using the polishing tool, a method of manufacturing an impeller, and the like are described taking an example of polishing of a wall of a flow path formed inside an impeller.

[Impeller]

First, a basic configuration of an impeller 10 that is a workpiece in the embodiment is described with reference to FIGS. 1A and 1B.

Figure 1A:
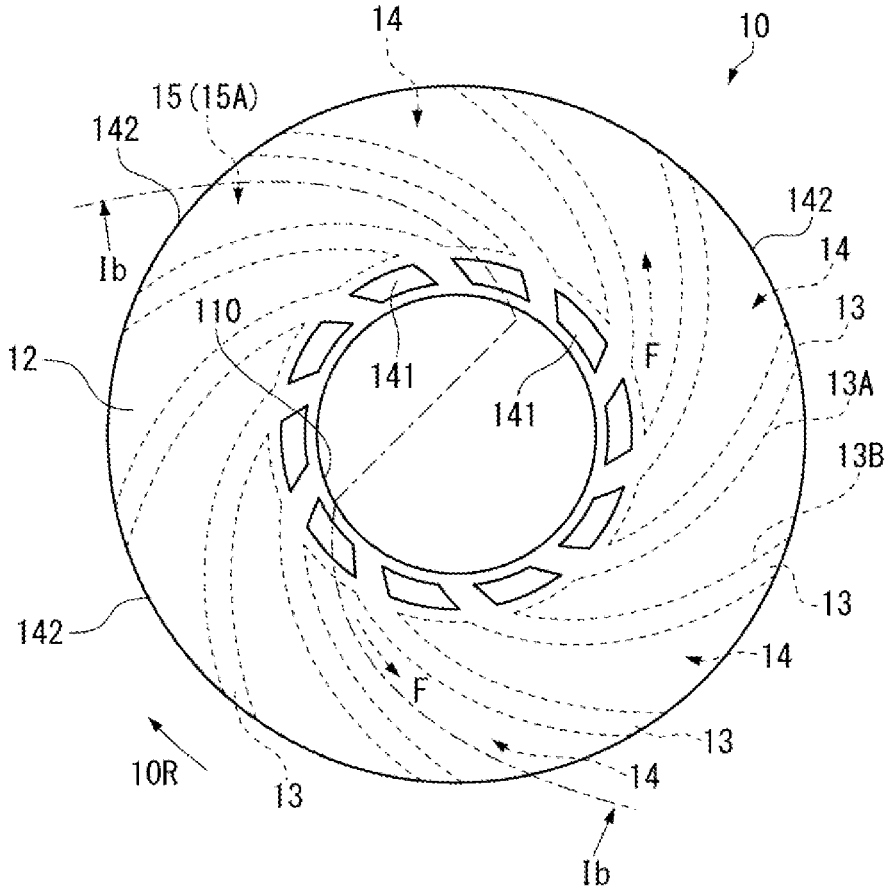
FIGS. 1A and 1B each illustrate an impeller (workpiece) according to an embodiment of the present disclosure, FIG. 1A being a plan view, and FIG. 1B being a cross-sectional view taken along a line Ib-Ib in FIG. 1A.
Figure 1B:
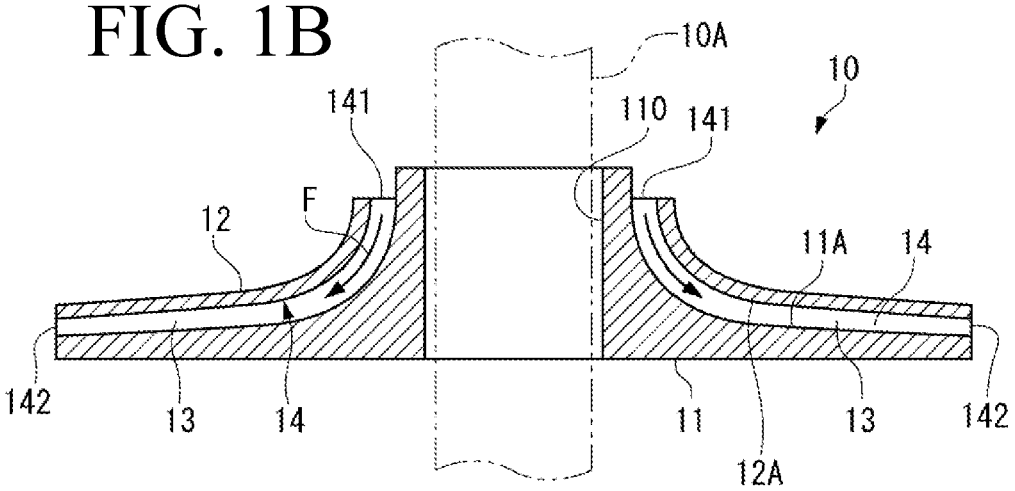

The impeller 10 is provided in a centrifugal rotary machine such as a centrifugal compressor that compresses working fluid, and is assembled to a rotary shaft 10A (FIG. 1B).

The impeller 10 includes a hub 11 in which the rotary shaft 10A is inserted into a shaft hole 110, a shroud 12 that faces a surface of the hub 11 with a predetermined distance, and a plurality of blades 13. A space between the hub 11 and the shroud 12 is partitioned by the plurality of blades 13 to form a plurality of flow paths 14.

The blades 13 and the flow paths 14 between the blades 13 each have a shape curved in both of a radial direction and an axis direction of the impeller 10 as illustrated in FIGS. 1A and 1B.

As illustrated in FIG. 1B, each of the flow paths 14 includes an upstream end 141 that opens in the axis direction on inner peripheral side of the impeller 10, and a downstream end 142 that opens in the radial direction on outer peripheral side of the impeller 10.

Each of the flow paths 14 is partitioned among the hub 11, the shroud 12, and the blades 13 adjacent to each other. The working fluid such as air comes into contact with a wall 15 of each of the hub 11, the shroud 12, and the blades 13 partitioning each of the flow paths 14.

As illustrated in FIGS. 1A and 1B, a surface 15A of the wall 15 of one flow path 14 includes a surface 11A of the hub 11, an inner surface 12A of the shroud 12, a face-side surface 13A of the blade 13, and a back-side surface 13B of the blade 13 facing the face-side surface 13A. The face-side surface 13A of the blade 13 protrudes toward the back-side surface 13B of the adjacent blade 13.

A height dimension of the flow path 14 from the surface of the hub 11 to the shroud 12 is gradually reduced and a width of the flow path 14 that corresponds to a dimension between the blades 13 adjacent to each other is gradually increased, as approaching from inner end side to outer end side of the impeller 10. A cross-sectional area of the flow path 14 is gradually increased as approaching from the inner end side to the outer end side of the impeller 10.

When the impeller 10 is rotated by an unillustrated power source in a direction of an arrow 10R (FIG. 1A), the working fluid inside the flow path 14 is accelerated by centrifugal force. As a result, the working fluid is sucked into the flow path 14 from the upstream end 141, is compressed while flowing through the flow path 14 in a direction illustrated by an arrow F in FIG. 1A, and is discharged from the downstream end 142 of the flow path 14.

To suppress friction loss of the working fluid caused by the wall 15 of the flow path 14, the surface 15A of the wall 15 is required to have sufficient smoothness. Accordingly, required surface roughness is achieved by polishing the wall 15 of the flow path 14 of the fabricated impeller 10.

The impeller 10 according to the present embodiment includes one member in which the hub 11, the blades 13, and the shroud 12 are integrated. The impeller 10 is made of an appropriate metal material such as low-alloy steel, stainless steel, and a titanium alloy by cutting, electro-discharge machining, or fused deposition modeling.

Unlike the present embodiment, the impeller 10 may include two members that are joined. For example, a member including the hub 11 and the blades 13, and the shroud 12 may be joined by welding. In this case, a wall surface of the flow path 14 is opened before the members are joined.

The flow path 14 of the impeller 10 is three-dimensionally curved, and the height and the width of the flow path 14 are changed in the flowing direction of the working fluid. Accordingly, the wall 15 of the flow path 14 has a complicated shape. It is difficult to polish such a complicated curved narrow part. In particular, when the impeller 10 is integrally fabricated from one member, the wall 15 of the flow path 14 is not exposed to outside of the hub 11 and the shroud 12, which makes polishing more difficult.

[Polishing Tool]

Next, a configuration of a polishing tool 20 (FIG. 2 and FIGS. 3A and 3B) used to polish the wall 15 of the flow path 14 of the impeller 10. The polishing tool 20 is applicable to the impeller 10 (FIGS. 1A and 1B) that is integrally fabricated from one member and is difficult in polishing, and achieves desired surface roughness of the complicated narrow wall 15 of the flow path 14.

Figure 3A:
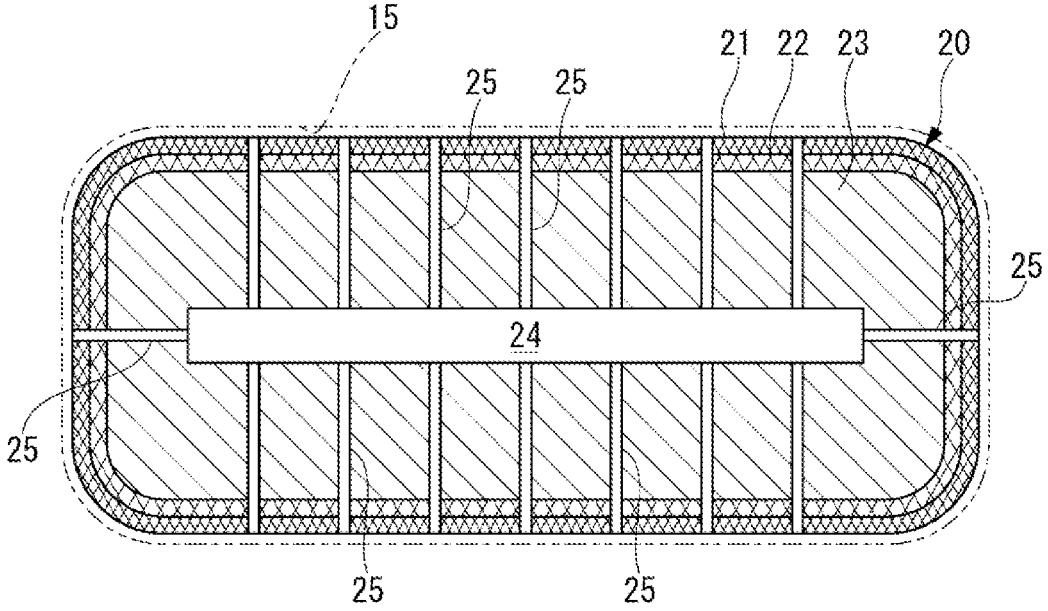
FIGS. 3A and 3B are cross-sectional views each illustrating the polishing tool according to a first embodiment, FIG. 3A being a cross-sectional view taken along a line IIIa-IIIa of FIG. 2, and FIG. 3B being a partial enlarged view of FIG. 3A.
Figure 3B:
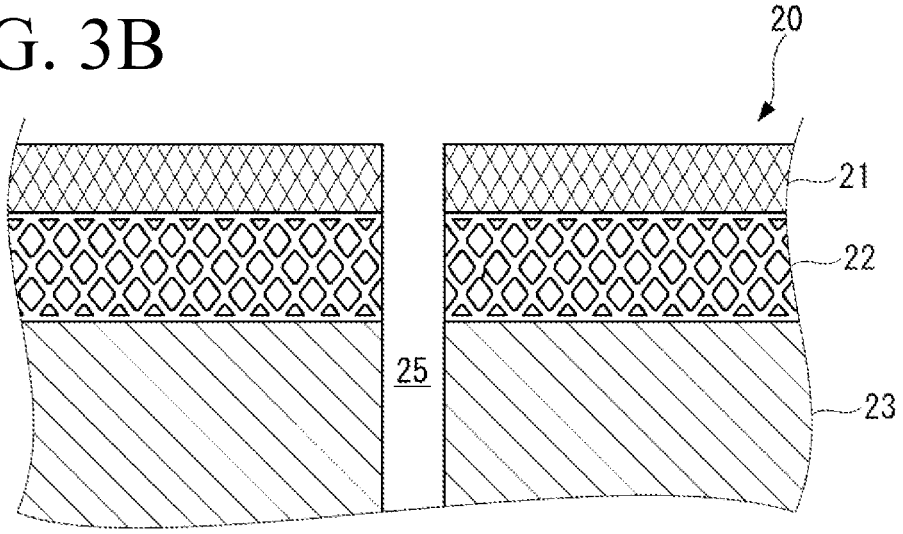

As illustrated in FIGS. 3A and 3B, the polishing tool 20 has main characteristics in a structure in which an abrasive retaining layer 21 as a surface layer and an elastic layer 22 are stacked.

The polishing tool 20 achieves both of abrasion resistance required for the surface layer brought close to the sliding wall 15 and elastic condition allowing for elastic deformation following the shape of each of the curved wall 15, by the structure in which the abrasive retaining layer 21 and the elastic layer 22 are stacked.

Note that an unillustrated adhesive layer and the like may be interposed between the abrasive retaining layer 21 and the elastic layer 22.

The abrasive retaining layer 21 and the elastic layer 22 are stacked over the substantially entire region of a body surface of the polishing tool 20.

The polishing tool 20 polishes the wall 15 of the flow path 14 by an abrasive 3 (FIG. 7) sliding on the wall 15 while the polishing tool 20 is inserted into the flow path (FIGS. 1A and 1B) from the upstream end 141 or the downstream end 142.

Figure 2:
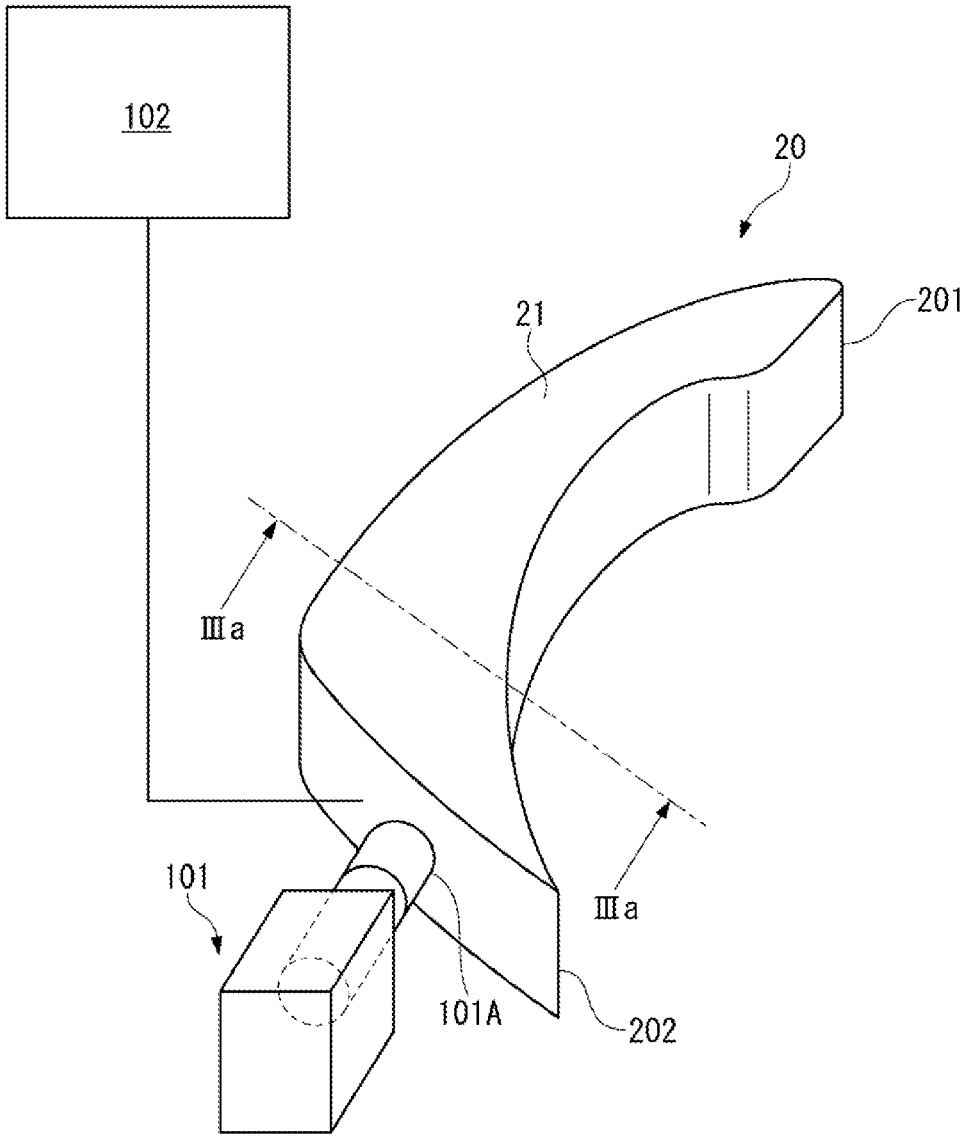
FIG. 2 is a diagram illustrating a polishing tool (perspective view) used for polishing a wall of a flow path of the impeller illustrated in FIGS. 1A and 1B, a driving unit driving the polishing tool, and an abrasive supplying apparatus.

FIG. 2 illustrates the polishing tool 20 to be inserted into the flow path 14 from the downstream end 142. It is possible to polish the wall 15 of the flow path 14 by the single polishing tool 20 depending on the shape of the flow path 14 of the impeller 10.

The polishing tool 20 according to the present embodiment is divided into an upstream polishing tool 20A (FIG. 6A) to be inserted into the flow path 14 from the upstream end 141, and a downstream polishing tool 20B (FIG. 6B) to be inserted into the flow path 14 from the downstream end 142, in consideration of elastic limit necessary for insertion into the flow path 14. The entire region of the wall 15 of the flow path 14 is polished by the polishing tools 20A and 20B.

In the following, any of the polishing tools 20A and 20B is referred to as the polishing tool 20 in a case where the polishing tools 20A and 20B are not distinguished from each other.

The polishing tool 20 (FIG. 2 and FIGS. 3A and 3B) has an outer shape taking after the flow path 14 from an inner end 201 located on the upstream end 141 side of the flow path 14 to an outer end 202 located on the downstream end 142 side of the flow path 14. The outer shape of the polishing tool 20 has a dimension slightly larger than a space surrounded by the wall 15 of the flow path 14.

The polishing tool 20 illustrated in FIG. 2 has a small thickness on the downstream side of the flow path 14 that is a front side of a paper surface in FIG. 2 and a large thickness on the upstream side of the flow path 14 on back side of a paper surface in FIG. 2, taking after the shape of the flow path 14.

When the polishing tool 20 is disposed inside the flow path 14, the body surface of the polishing tool 20 is surrounded by the wall 15 of the flow path 14. At this time, the abrasive 3 retained in the abrasive retaining layer 21 is pressed against the wall 15 with stable pressure by the elastic layer 22 that is compressed by the wall 15 and is elastically deformed.

[Polishing Tool According to First Embodiment]

As illustrated in FIG. 2, the polishing tool 20 according to the first embodiment is used together with a driving unit 101 that causes the polishing tool 20 to slide on the wall 15 of the flow path 14, and an abrasive supplying apparatus 102 that supplies the abrasive 3 between the polishing tool 20 and the wall 15.

The abrasive supplying apparatus 102 is connected to an abrasive flow path 24 (FIG. 3A) that is provided in the polishing tool 20.

The driving unit 101 is connected to one of end parts of the polishing tool 20. In a case where the polishing tool 20 is inserted from the downstream end 142 of the flow path 14 as illustrated in FIG. 6B, the driving unit 101 (FIG. 2) is connected to the outer end 202 of the polishing tool 20.

The driving unit 101 includes, for example, a hydraulic cylinder including a piston and a cylinder. The driving unit 101 reciprocates the polishing tool 20 in the radial direction of the impeller 10, or in a direction of a shaft part 101A that is set in a direction shifted from the radial direction of the impeller 10 along the direction of the flow path 14.

Note that the direction in which the polishing tool 20 is driven by the driving unit 101 is not necessarily limited to a linear direction. The polishing tool may be driven along a curved trajectory appropriately set such that the polishing tool 20 slides while smoothly following the wall 15 of the flow path 14.

The driving unit 101 and the abrasive supplying apparatus 102 make it possible to automate the polishing processing of sliding the abrasive 3 retained in the polishing tool 20 with the wall 15 while supplying the abrasive 3 to the body surface of the polishing tool 20 inserted into the flow path 14.

As illustrated in FIGS. 3A and 3B, the polishing tool 20 according to the present embodiment includes the abrasive retaining layer 21 allowing the abrasive 3 (FIG. 7) to be retained, the elastic layer 22 staked on the abrasive retaining layer 21, and a support 23 that supports the abrasive retaining layer 21 and the elastic layer 22.

(Abrasive)

As the abrasive 3 (FIG. 7) used in the polishing tool 20, abrasive grains 3A for grinding and polishing that are each formed to have a grain size and a shape appropriate to polishing, from an alumina-based material, a silicon carbide-based material, and the like that are matched to a metal material used for the impeller 10. The shape of each of the abrasive grains 3A is optional including an unstable shape without being limited a columnar shape illustrated in FIG. 7.

In the present embodiment, the abrasive grains 3A are supplied to the body surface of the polishing tool 20 by the abrasive supplying apparatus 102 (FIG. 2) through the abrasive flow path 24 and abrasive flow paths 25 (FIG. 3A) provided in the polishing tool 20. The abrasive 3 used in the polishing tool 20 according to the present embodiment includes the abrasive grains 3A and a dispersion medium (not illustrated) having fluidity, and has fluidity as a whole. A ratio of the abrasive grains to the dispersion medium is, for example, equal to or lower than 10 wt. %. The ratio is not limited thereto, and may be determined to an appropriate ratio in consideration of the desired surface roughness, a time necessary for polishing, and the like.

The medium (dispersion medium) in which the abrasive grains 3A are dispersed preferably has viscoelasticity. Elasticity of the dispersion medium contributes to friction force between the abrasive grains 3A and the wall 15 necessary for polishing of the wall 15, and viscosity of the dispersion medium keeps the abrasive grains 3A on the wall 15 and the surface layer of the polishing tool 20 to efficiently bring the abrasive grains 3A into contact with the wall 15.

(Abrasive retaining layer)

The abrasive retaining layer 21 (FIGS. 3A and 3B) causes the abrasive 3 (in particular, abrasive grains 3A) to be retained on at least the surface. The abrasive 3 retained in the abrasive retaining layer 21 slides on the wall 15, thereby polishing the wall 15. The abrasive retaining layer 21 preferably has abrasion resistance.

Causing the abrasive grains 3A of the abrasive 3 to be retained in the abrasive retaining layer 21 to suppress discharge of the abrasive grains 3A to outside of the polishing tool 20 improves polishing efficiency.

Slight displacement of the abrasive 3 in the abrasive retaining layer 21 is allowed as long as the abrasive 3 is retained in the abrasive retaining layer 21 to slide on the wall 15.

The abrasive retaining layer 21 is made of an appropriate material such as a resin material and a metal material. The abrasive retaining layer 21 has a rough surface to allow the abrasive 3 to be retained on the surface.

For example, a porous body or a mesh-like member including gaps each smaller in size than each of the abrasive grains 3A, or a sheet in which irregularities (including wavy shape) allowing the abrasive 3 to be retained is provided on a surface by machining, etching or the like may be used as the abrasive retaining layer 21.

The abrasive retaining layer 21 is hardly deformed because of rigidity higher than rigidity of the elastic layer 22. The abrasive retaining layer 21 is elastically deformable within limit necessary to allow the polishing tool 20 to follow the surface shape of the wall 15. The abrasive retaining layer 21 according to the present embodiment has density higher than density of the elastic layer 22.

(Elastic Layer)

The elastic layer 22 (FIGS. 3A and 3B) is staked on rear side of the abrasive retaining layer 21, and presses the abrasive 3 retained in the abrasive retaining layer 21 against the wall 15 of the flow path 14. The elastic layer 22 is preferably formed to have a fixed thickness over the entire region.

The elastic layer 22 is easily elastically deformed as compared with the abrasive retaining layer 21 because of small elasticity. The polishing tool 20 as a whole has flexibility derived from the elastic layer 22.

The abrasive 3 is pressed against the surface of the wall 15 through the abrasive retaining layer 21 by elastic force of the elastic layer 22 that is elastically deformed inside the flow path 14, which makes it possible to uniformly bring the abrasive 3 into contact with the wall 15. The elastic layer 22 is elastically deformable over a sliding stroke of the polishing tool 20.

In order to deform the elastic layer 22 within an elastic range when the polishing tool 20 is inserted into the flow path 14 and over the stroke of the polishing tool 20 sliding on the wall 15 of the flow path 14, the elastic layer 22 has an appropriate thickness and an elastic condition.

Appropriately setting the configuration and the thickness of the elastic layer 22 makes it possible to adjust surface pressure of the elastic layer 22.

According to the polishing tool 20 including the stacked-layer structure of the elastic layer 22 and the abrasive retaining layer 21, it is possible to provide, to the elastic layer 22, the elastic condition allowing for elastic deformation following the shape of the wall 15, while the abrasion resistance and the rigidity necessary to hold the abrasive 3 are secured by the abrasive retaining layer 21.

It is basically difficult to achieve the abrasion resistance and the elastic condition necessary for the polishing tool 20 by a single layer, like an elastic grinding wheel. This is because, in a case where a single solid body is used to polish the complicatedly-curved wall 15, the elastic range allowing for sufficient follow-up to the wall 15 cannot be secured for the member. Further, hardness of the elastic grinding wheel is insufficient to polish, for example, Inconel (registered mark) having hardness higher than the hardness of the elastic grinding wheel.

Although the polishing tool 20 is used for a direct polishing method in which the polishing tool 20 slides on the workpiece as with the elastic grinding wheel, the polishing tool 20 can achieve the elastic limit allowing for follow-up to the shape of the wall 15 of the flow path 14 including the deformed cross-section because the polishing tool 20 includes the elastic layer 22 and the abrasive retaining layer 21 as separated layers. The configuration in which the elastic layer 22 and the abrasive retaining layer 21 are stacked makes it possible to surely provide necessary characteristics to the polishing tool 20 by sharing the characteristics by the layers.

The elastic layer 22 according to the present embodiment includes a lattice structure. The "lattice structure" corresponds to branched lattices that are periodically arranged. A gap is provided inside each of the lattices.

The elastic layer 22 includes the lattice structure as a whole. The elastic layer 22 preferably has isotropy by the lattice structure. "Isotropy" indicates a property in which deformation response to a load is independent of a direction. When the elastic layer 22 has isotropy, the abrasive 3 is pressed against the curved wall 15 with uniform pressure.

According to the lattice structure, it is possible to suppress a usage of the material to reduce a material cost as compared with a solid member that is made of the same material and has the same outer shape, and to provide appropriate characteristics to the elastic layer 22 by changing the dimension and the shape of each of the lattices to change the density even with the same material.

The elastic layer 22 including the lattice structure is fabricated by additive manufacturing using a resin material such as polyurethane. For example, a polyurethane elastomer material including the lattice structure that is obtained by 3D printer M1 available from Carbon 3D, Inc. in the U.S. is used for the elastic layer 22. Such a polyurethane elastomer material is matched to the elastic layer 22 that is compressed and elastically deformed inside the wall 15 because such a polyurethane elastomer material has abrasion resistance and high compressive strength.

The additive manufacturing is a technology to obtain a three-dimensional object through a process of supplying a use material to necessary parts for each layer and curing the material, based on two-dimensional slice data obtained from three-dimensional data of a shape of the object. A heat ray or a light beam is applied to the use material to melt or solidify the use material as necessary. According to the additive manufacturing, it is possible to easily fabricate an object having a complicated shape including a narrow internal gap.

The elastic layer 22 is fabricable by fused deposition modeling using a thermoplastic resin or a thermosetting resin, or stereo lithography using a photo-curing resin such as ultraviolet-curing resin. The above-described polyurethane is a thermosetting resin and is also a photo-curing resin. According to the above-described 3D printer M1, it is possible to shape a solid rigid polyurethane material and the like, in addition to the lattice-shaped or porous polyurethane elastomer material, by using stereo lithography as a basic technology.

(Support)

The support 23 is made of an appropriate material such as a resin material and a metal material, and supports the abrasive retaining layer 21 and the elastic layer 22 from rear side of the elastic layer 22. The support 23 has rigidity necessary to maintain the polishing tool 20 in a predetermined shape.

The support 23 is wholly covered with the stacked-layer structure including the abrasive retaining layer 21 and the elastic layer 22.

As described above, the shaft part 101A (FIG. 2) connected to the driving unit 101 is provided in the support 23 at one end of the polishing tool 20.

(Flow Path)

The support 23 according to the present embodiment is provided with the abrasive flow paths 24 and 25 through which the abrasive 3 flows. The abrasive flow paths 24 and 25 are gaps provided in the support 23. The abrasive flow paths 24 and 25 may be each configured of a pipe incorporated inside the polishing tool 20. The pipe is preferably an elastic body having moderate followability in order to contribute to follow-up to the wall 15 of the flow path 14.

The first abrasive flow path 24 is a hollow space inside the support 23, and is supplied with the abrasive 3 from the abrasive supplying apparatus 102 (FIG. 2) disposed outside the impeller 10. The first abrasive flow path 24 is continuous from the inner end 201 to the outer end 202 of the polishing tool 20. The abrasive 3 may be supplied to the first abrasive flow path 24 through the inside of the shaft part 101A connected to the driving unit 101. Further, a circuit in which the abrasive 3 circulates between the abrasive supplying apparatus 102 and the body surface of the polishing tool 20 may be configured.

The large number of second abrasive flow paths 25 extend from the first abrasive flow path 24 toward the body surface of the polishing tool 20. Each of the second abrasive flow paths 25 supplies the abrasive 3 from the first abrasive flow path 24 to the body surface of the polishing tool 20. The second abrasive flow paths 25 preferably range over the entire body surface of the polishing tool 20.

[Manufacture of Polishing Tool]

For example, the abrasive retaining layer 21, the elastic layer 22, and the support 23 that are fabricated by respective appropriate methods are joined by an appropriate method such as bonding and fastening, and the shaft part 101A is fixed to the support 23. As a result, the polishing tool 20 is obtained. The elastic layer 22 may be fabricated by additive manufacturing. The abrasive retaining layer 21 and the support 23 may be also fabricated by additive manufacturing.

The abrasive retaining layer 21 and the elastic layer 22 may be integrally fabricated by additive manufacturing.

Figure 4A:
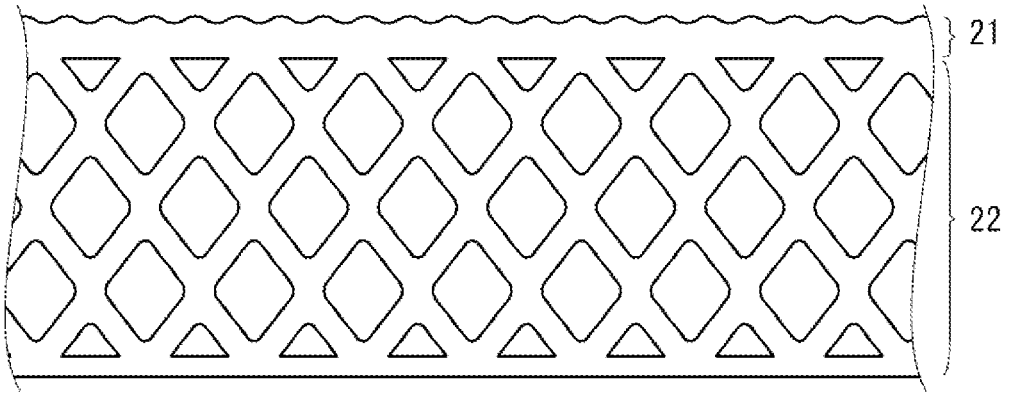
FIGS. 4A and 4B are cross-sectional views each illustrating an abrasive retaining layer and an elastic layer that are integrally fabricated by additive manufacturing.

FIG. 4A illustrates the abrasive retaining layer 21 and the elastic layer 22 that are integrally fabricated by additive manufacturing with use of polyurethane.

The structures of the abrasive retaining layer 21 and the elastic layer 22 that are integrally fabricated, are different from each other. The elastic layer 22 includes a lattice structure, whereas the abrasive retaining layer 21 includes a solid structure.

The abrasive retaining layer 21 may include abrasion resistance derived from polyurethane as a material. A wavy shape that retains the abrasive grains of the abrasive is provided on the surface of the abrasive retaining layer 21 by additive manufacturing, and the abrasive retaining layer 21 has large surface roughness.

Figure 4B:
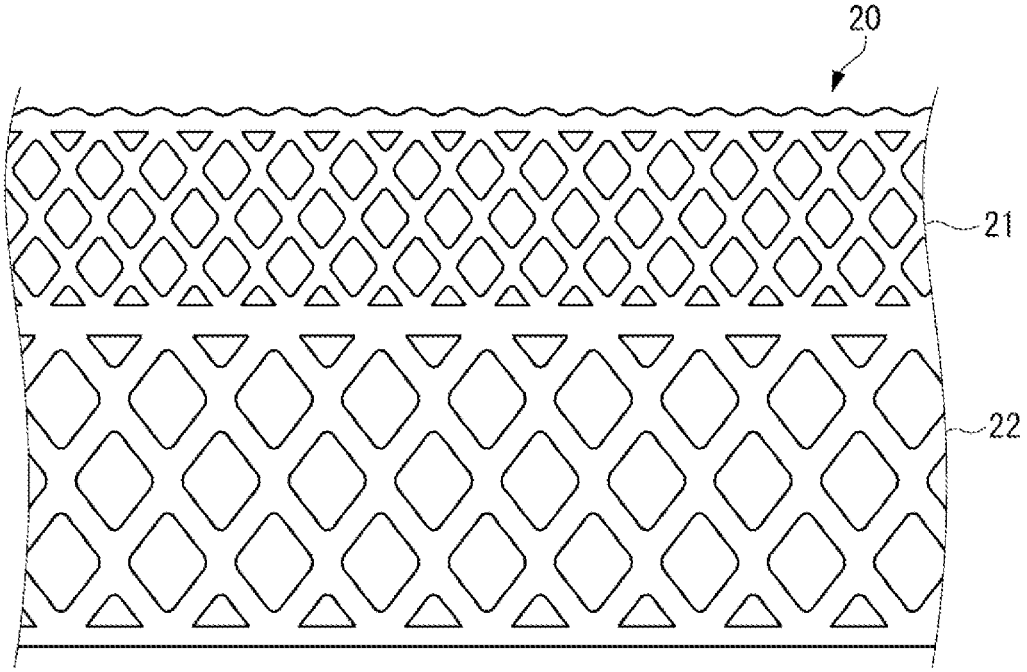

The abrasive retaining layer 21 and the elastic layer 22 illustrated in FIG. 4B are also integrally fabricated by additive manufacturing. The abrasive retaining layer 21 and the elastic layer 22 both include a lattice structure but are different in density from each other. The density of the abrasive retaining layer 21 is higher than the density of the elastic layer 22.

A wavy shape that retains the abrasive grains of the abrasive is also provided on the surface of the abrasive retaining layer 21 illustrated in FIG. 4B by additive manufacturing, and the abrasive retaining layer 21 has large surface roughness.

As illustrated in FIGS. 4A and 4B, the members at least partially including a lattice structure are integrally fabricated by additive manufacturing, which makes it possible to suppress an amount of use material and to reduce a manufacturing cost of the polishing tool 20.

Further, the whole of the polishing tool 20 that includes the support 23 including the abrasive flow paths 24 and 25 and the shaft part 101A (FIG. 2) is integrally fabricable by additive manufacturing.

[Dividing of Tool]

Figure 5:
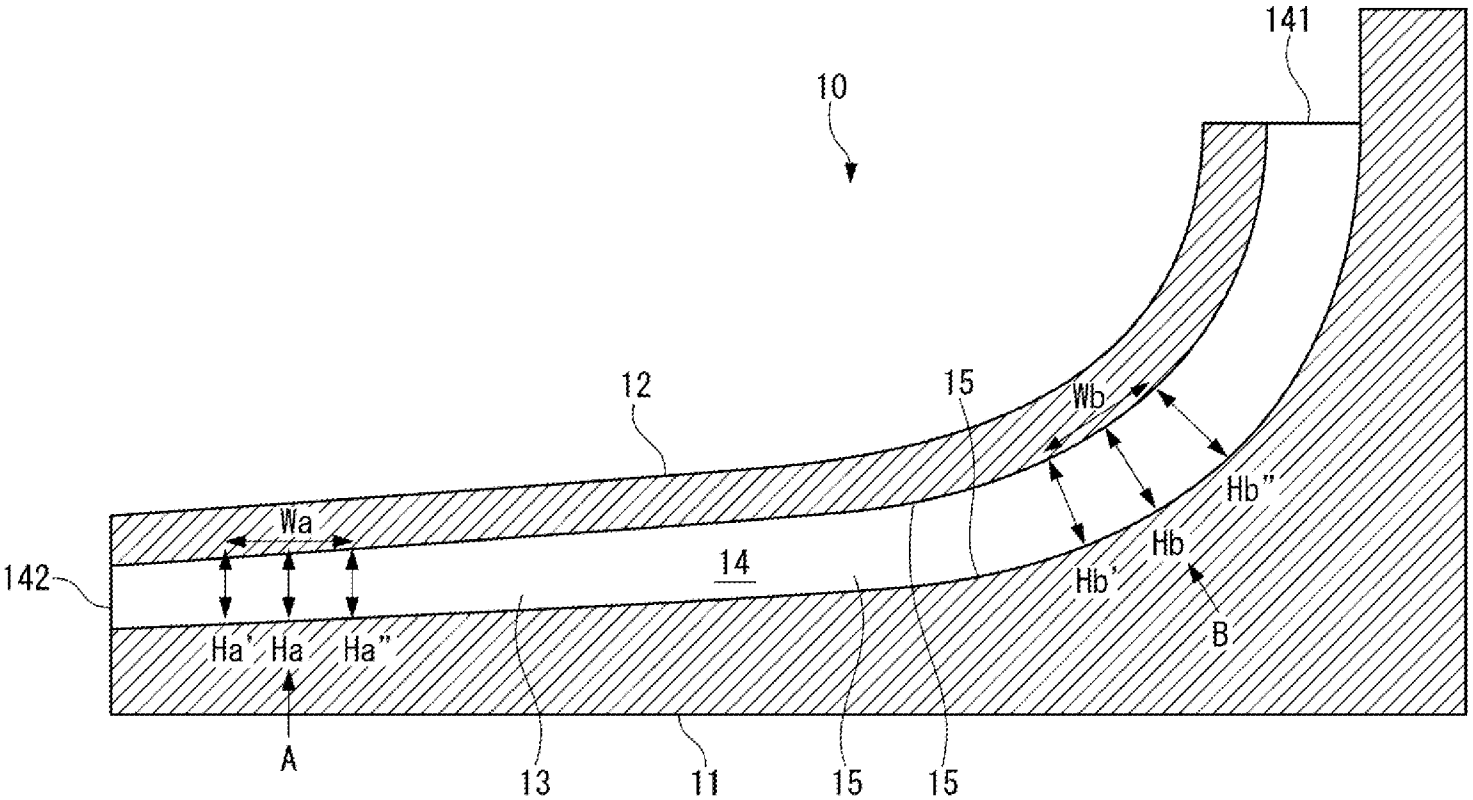
FIG. 5 is a diagram to explain basic idea about dividing of a polishing tool.

A basic idea to divide the polishing tool 20 in the flowing direction of the flow path 14 is described with reference to FIG. 5.

First, a range (stroke) where the polishing tool 20 slide is denoted by Wa while centering an optional point A in the flow path 14, and a height of the flow path 14 is denoted by Ha. A displacement ΔHa of the height of the flow path 14 in the stroke Wa is obtained from Ha"-Ha', and a stretching width necessary for the elastic layer 22 in the stroke Wa also becomes ΔHa. The thickness and the elastic condition of the elastic layer 22 are determined from the stretching width ΔHa.

Likewise, when considering a point B in the flow path 14, a displacement ΔHb of the height of the flow path 14 in a stroke Wb (≈Wa) is obtained from Hb"-Hb', and the stretching width necessary for the elastic layer 22 in the stroke Wb also becomes ΔHb. The stretching width ΔHb is different from the stretching width ΔHa relating to the point A.

Accordingly, the thickness and the elastic condition of the elastic layer 22 that are calculated based on the maximum stretching width (ΔHx) of the entire flow path 14 are basically adopted. When the elastic condition is achievable in the elastic layer 22, it is unnecessary to divide the polishing tool 20. In contrast, when the elastic condition is not achievable in the elastic layer 22, it is necessary to divide the polishing tool 20.

Note that the entire region of the flow path 14 is not necessarily polished only by the polishing tool 20. For example, a range of the wall 15 of the flow path 14 visible from the upstream end 141 may be polished by machining or with use of an elastic grinding wheel, and a remaining range may be polished by the polishing tool 20.

As for the stretching width in the width direction of the flow path 14 accompanied with sliding of the polishing tool 20, the maximum stretching width in the width direction over the entire region of the flow path 14 is determined by considering similarly to the height of the flow path 14 described above. Whether to divide the polishing tool 20 or not may be determined based on the dimension in the width direction and the elastic condition of the elastic layer 22 calculated from the maximum stretching width.

[Manufacture of Impeller]

After a fabrication step of fabricating the impeller 10 by an optional method such as cutting and fused deposition modeling, a polishing step of polishing the wall 15 of the flow path 14 by the polishing tool 20 is performed.

Figure 6A:
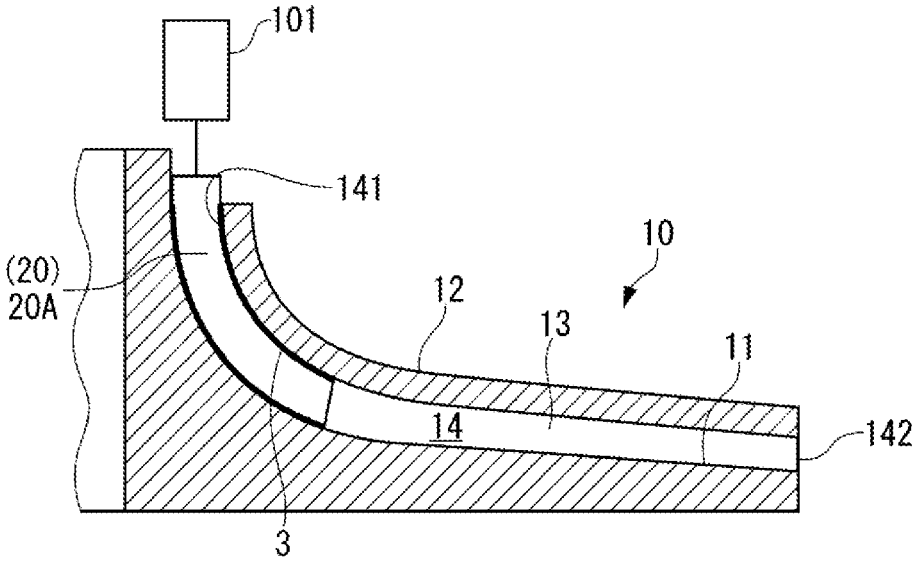
FIG. 6A is a diagram illustrating a polishing tool used for upstream side of a flow path.
Figure 6B:
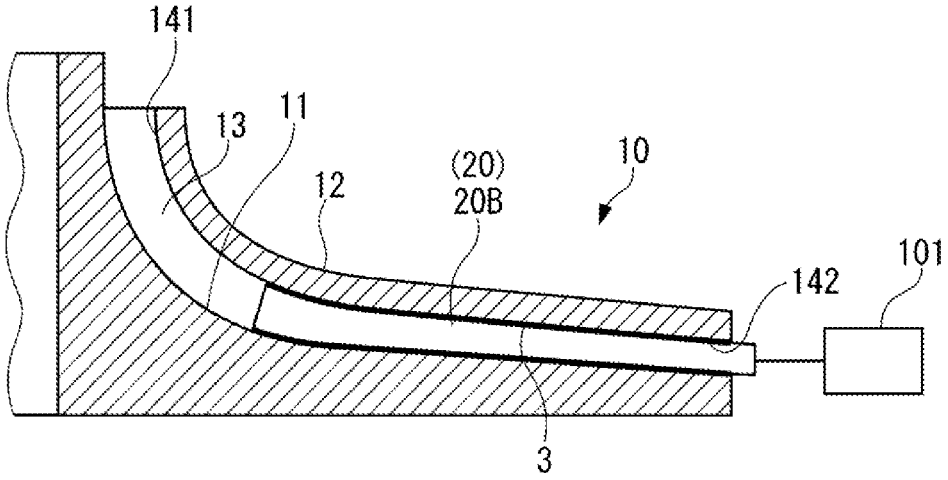
FIG. 6B is a diagram illustrating a polishing tool used for downstream side of the flow path.

As illustrated in FIGS. 6A and 6B, in the polishing step, the polishing tool 20 (20A or 20B) is inserted into the flow path 14. At this time, the polishing tool 20 is flexibly deformed mainly due to elastic deformation of the elastic layer 22, and is accordingly smoothly inserted into the flow path 14.

The polishing tool 20 inserted into the flow path 14 is reciprocated by the driving unit 101 (FIG. 2), to slide the abrasive 3 retained in the surface layer of the polishing tool 20 with the wall 15, thereby polishing the wall 15.

After the wall 15 on the upstream side is polished while the polishing tool 20A (FIG. 6A) is inserted into the flow path 14, the polishing tool 20A is taken out from the flow path 14. Thereafter, the polishing tool 20B is inserted into the flow path 14 as illustrated in FIG. 6B to polish the wall 15 on the downstream side. This is illustrative, and polishing may be performed by, for example, inserting both of the polishing tools 20A and 20B into the same flow path 14 by other procedure.

Figure 7:
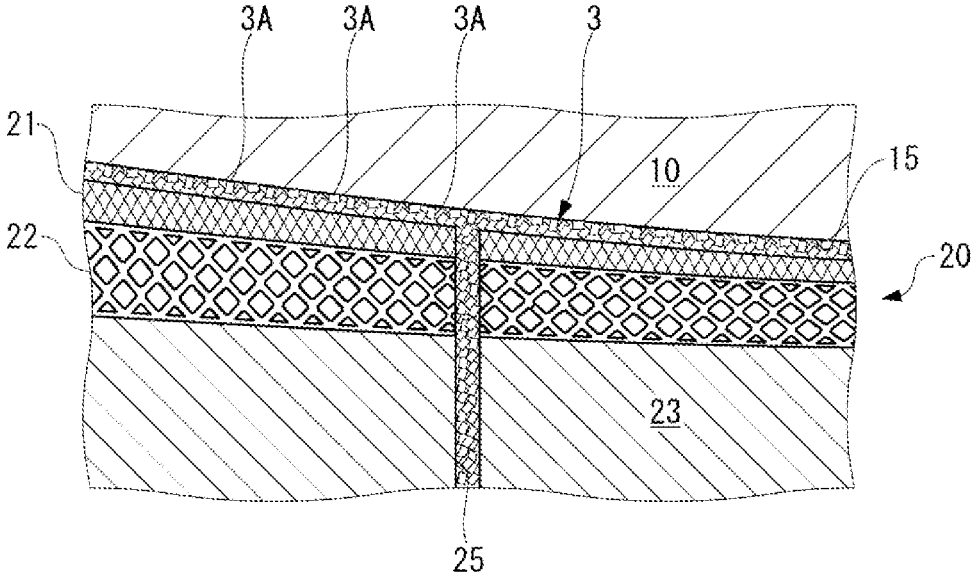
FIG. 7 is a diagram illustrating a state where an abrasive on a surface layer of the polishing tool is pressed against a wall of the flow path by the elastic layer of the polishing tool inserted into the flow path.

As illustrated in FIG. 7, the polishing tool 20 is compressed inside the wall 15 to mainly cause the elastic deformation of the elastic layer 22. As a result, the entire body surface of the polishing tool 20 follows the surface of the wall 15. Further, the abrasive 3 retained in the abrasive retaining layer 21 slides on the wall 15 while being pressed against the wall 15 by the elastic layer 22, over the entire body surface of the polishing tool 20. Since the entire region of the elastic layer 22 is elastically deformable over the sliding stroke of the polishing tool 20, the abrasive 3 is pressed, by the elastic layer 22, against the surface of the wall 15 with stable uniform pressure, over the entire body surface of the polishing tool 20, during the polishing.

Before execution of the polishing step, the fabricated impeller 10 is positioned on a workbench. The driving unit 101 may be configured so as to automatically insert the polishing tool 20 into the flow path 14 of the impeller 10.

The abrasive 3 is supplied, by the abrasive supplying apparatus 102 (FIG. 2), to the body surface of the polishing tool 20 through the first abrasive flow path 24 and the second abrasive flow paths 25. The abrasive 3 that is fluid in which the abrasive grains 3A are dispersed spreads to the abrasive retaining layer 21 from each of the abrasive flow paths 25 ranging over the body surface of the polishing tool 20, and permeates the entire region of the abrasive retaining layer 21. The abrasive supplying apparatus 102 supplies the abrasive 3 to the body surface of the polishing tool 20 at least either before start of the polishing or during the polishing. The abrasive 3 that has reached the body surface of the polishing tool 20 through the second abrasive flow paths 25 is supplied to the abrasive retaining layer 21 in place of the abrasive 3 including the abrasive grains 3A worn away by the polishing.

The polishing of the wall 15 on the upstream side by the polishing tool 20A and the polishing of the wall 15 on the downstream side by the polishing tool 20B are performed on each of the flow paths 14.

Although the plurality of flow paths 14 may be sequentially polished by the polishing tools 20 (20A and 20B), the polishing tool 20 is inserted into each of the plurality of flow paths 14 to simultaneously perform the polishing of the flow paths 14, which makes it possible to reduce the time necessary for the polishing step. In this case, the polishing tools 20A and 20B corresponding to the flow paths 14 are desirably supported by an unillustrated annular tool.

After the above-described polishing step, for example, processing of performing coating to prevent erosion may be performed on the wall 15 of the flow path 14 as necessary. Finally, the impeller 10 is manufactured.

According to the polishing tool 20 of the present embodiment, the abrasive 3, which is retained in the abrasive retaining layer 21 over the entire region of the body surface of the polishing tool 20, slides while being directly pressed against the surface of the wall 15 by elastic force uniform over the entire region of the elastic layer 22. As a result, it is possible to surely and uniformly bring the abrasive 3 into contact with the surface of the wall 15 to perform polishing. The polishing is performed while the abrasive 3 is surely brought into contact with the wall 15, which improves efficiency of the polishing. Accordingly, it is possible to eliminate polishing unevenness to achieve the desired surface roughness of the wall 15 while largely reducing the time necessary for the polishing as compared with a polishing method inferior in contact probability of the abrasive to the wall 15. Reduction of the time necessary for the polishing allows for mass production of the impeller 10.

[First Modification]

Figure 8:
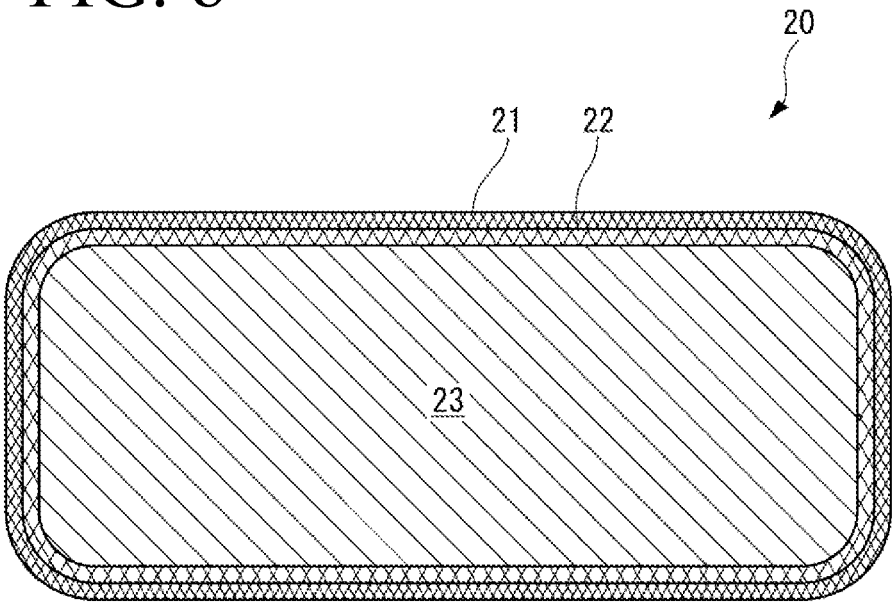
FIG. 8 is a cross-sectional view illustrating a solid polishing tool according to a first modification of the present disclosure.

The polishing tool 20 may not necessarily include the polishing flow paths 24 and 25 (FIG. 3A). In an example illustrated in FIG. 8, the abrasive flow paths 24 and 25 are not provided in the support 23. The polishing tool 20 illustrated in FIG. 8 is configured in solid.

When the abrasive is supplied to the surface layer of the polishing tool 20 before the polishing tool 20 is inserted into the flow path 14, the abrasive is retained in the abrasive retaining layer 21. The polishing tool 20 in this state is inserted into the flow path 14, and the polishing tool 20 is slid on the wall 15 by the driving unit 101 or by hand. This makes it possible to uniformly polish the wall 15 by the abrasive that is directly pressed against the wall 15 by elastic force uniform over the entire region of the elastic layer 22.

To supply the abrasive to the surface layer of the polishing tool 20, the polishing tool 20 is preferably immersed in the abrasive 3, and the abrasive 3 is preferably impregnated in the abrasive retaining layer 21 over the entire body surface of the polishing tool 20. Alternatively, the surface layer of the polishing tool 20 may be rubbed against a semisolid abrasive.

[Second Modification]

Figure 9:
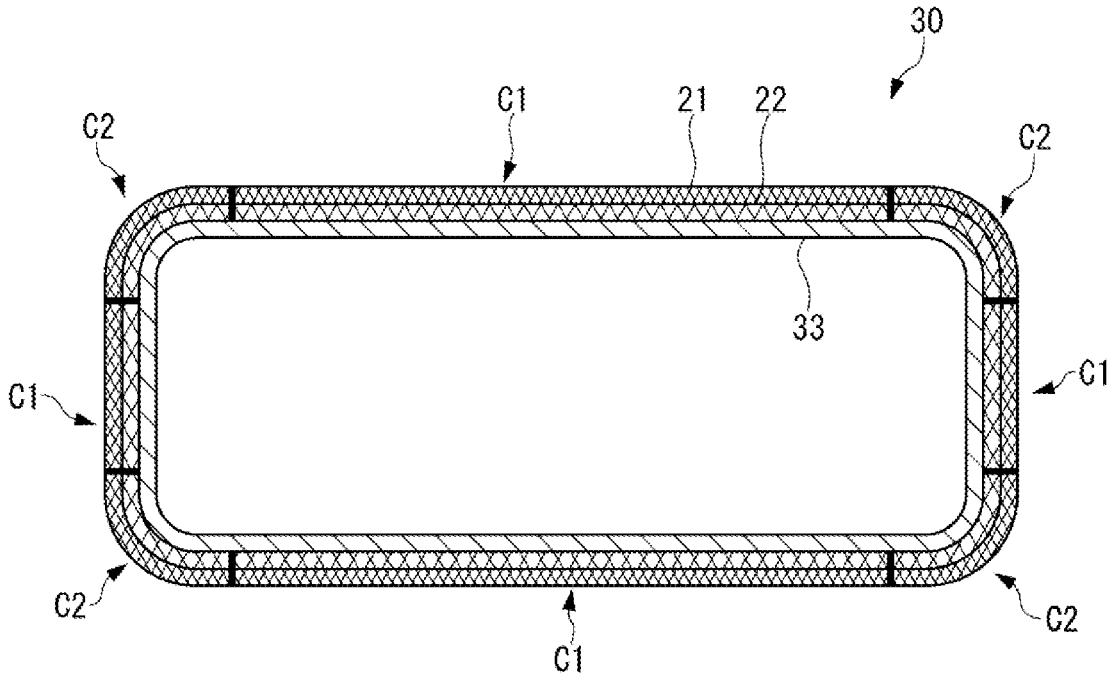
FIG. 9 is a cross-sectional view illustrating a hollow polishing tool according to a second modification of the present disclosure.

FIG. 9 illustrates a polishing tool 30 suitable for the flow path 14 having a large cross-sectional area.

The polishing tool 30 includes the abrasive retaining layer 21, the elastic layer 22, and a hollow support 33 that supports the abrasive retaining layer 21 and the elastic layer 22. The polishing tool 30 includes the hollow support 33 in place of the support 23 that is provided in the polishing tool 20 illustrated in FIGS. 3A and 3B and FIG. 8.

The support 33 has rigidity necessary to support the elastic layer 22 and the abrasive retaining layer 21.

Even when the inside of the support 33 is hollow, the elastic layer 22 and the abrasive retaining layer 21 are supported by the support 33. Therefore, the polishing tool 30 is not excessively deformed by own weight. Accordingly, the polishing tool 30 is preferably configured to be hollow in terms of suppression of its weight and a usage of the material.

The abrasive may be supplied to the body surface of the polishing tool 30 by forming, in the elastic layer 22 and the abrasive retaining layer 21, paths similar to the second abrasive flow paths 25 illustrated in FIG. 3A, and filling the inside of the support 33 with the abrasive.

The support 33 is preferably an elastic body having moderate followability in order to contribute to follow-up to the surface of the wall 15 of the flow path 14.

In a case where it is not possible to set, in the support 33, the thickness and the elastic condition that copes with the maximum stretching amount in the entire region of the flow path 14, the support 33 is preferably divided into a part on the upstream side and a part on the downstream side of the flow path 14. In this case, the abrasive retaining layer 21 and the elastic layer 22 are formed so as to be continuous over the entire region of the flow path 14, and the abrasive retaining layer 21 and the elastic layer 22 are supported by divided supports 33. This makes it possible to integrally configure the whole of the polishing tool 30.

In consideration of portability and workability of a member in manufacturing the large polishing tool 30, for example, the abrasive retaining layer 21 and the elastic layer 22 are each divided, at a position illustrated by a thick line in FIG. 9, into flat parts Cl each along one surface of the wall 15 of the flow path 14, and parts C2 curved at respective corners each connecting wall surfaces adjacent to each other.

An example of a method of manufacturing the polishing tool 30 is described.

Before manufacture of the polishing tool 30, flat sheets and curved corner sheets of each of the abrasive retaining layer 21 and the elastic layer 22 are separately manufactured.

When the elastic layer 22 is provided on the support 33, the flat sheets (C1) and the corner sheets (C2) are cut into shapes along the outer surface of the support 33, and these sheets are joined to the support 33 so as to cover the entire outer surface of the support 33. Likewise, as for the abrasive retaining layer 21, the flat sheets and the corner sheets that have been cut into shapes along the outer surface of the elastic layer 22 are joined to the elastic layer 22 so as to cover the elastic layer 22.

[Third Modification]

Figure 10:
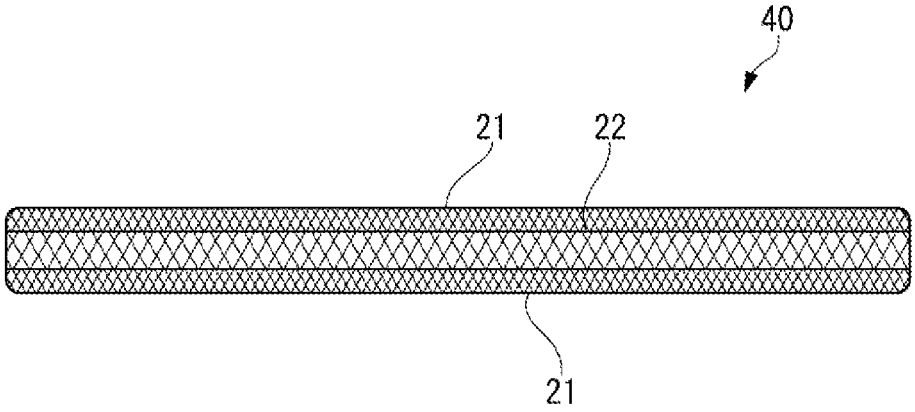
FIG. 10 is a cross-sectional view illustrating a polishing tool not including a support according to a third modification.

FIG. 10 illustrates a polishing tool 40 that corresponds to the flow path 14 having a small height.

The polishing tool 40 includes the elastic layer 22 and the abrasive retaining layer 21 that is stacked on each of front and rear surfaces of the elastic layer 22. The polishing tool 40 does not include a support that supports the abrasive retaining layer 21 and the elastic layer 22. Accordingly, it is possible to secure the thickness of the elastic layer 22 by a thickness of a non-existent support in the thin polishing tool 40. The abrasive is stably pressed by the elastic layer 22 against the wall 15 through the abrasive retaining layer 21 while the whole of the polishing tool 40 is pressed inside the wall 15 of the flow path 14.

Other than the above, the configurations described in the above-described embodiment may be selected or appropriately modified without departing from the scope of the present disclosure.

The present disclosure is suitable for polishing of a part having a complicated shape in various workpieces, in addition to the flow path of the impeller. For example, the present disclosure is suitable for a member including a plurality of blades, and specific examples thereof include a diaphragm of a multistage centrifugal compressor.

What is claimed is:

1. A method of manufacturing an impeller, the method comprising:

fabricating an impeller including a flow path; and polishing a wall of the flow path of the impeller by sliding a polishing tool along the wall of the flow path of the impeller, the polishing tool comprising:

an abrasive retaining layer disposed on two or more non-coplanar sides of the polishing tool and that retains, on surfaces of the two or more sides of the polishing tool, an abrasive fluid in which abrasive grains are dispersed;

an elastic layer that is stacked on a rear side of the abrasive retaining layer;

a first abrasive flow path that:

is a hollow space inside a support supporting the abrasive retaining layer and the elastic layer, and extends from a first end to a second end in a longitudinal direction of the polishing tool; and second abrasive flow paths that extend from the first abrasive flow path to predetermined positions on a surface of the abrasive retaining layer opposite to the elastic layer, wherein, in each of the two or more sides of the polishing tool, one or more of the predetermined positions are disposed over the surface of the abrasive retaining layer, wherein the polishing comprises:

pressing the abrasive fluid, retained on the surface of the abrasive retaining layer, against the wall of the impeller to polish the wall; and polishing the wall with the abrasive retaining layer interposed between the elastic layer and the wall.

2. The method of manufacturing an impeller according to claim 1, wherein the wall of the flow path of the impeller is polished by deforming the elastic layer within an elastic range while causing the abrasive retaining layer to follow the wall of the flow path of the impeller.

3. The method of manufacturing an impeller according to claim 1, wherein the second abrasive flow paths extend through the elastic layer and deform with elastic deformation of the elastic layer.

4. The method of manufacturing an impeller according to claim 1, wherein the impeller is made of a metal material.

* * * * *